US008945265B2

(12) United States Patent
Nakashima et al.

(10) Patent No.: US 8,945,265 B2
(45) Date of Patent: Feb. 3, 2015

(54) COMPRESSOR

(75) Inventors: Akihiro Nakashima, Aichi-ken (JP); Shinichi Sato, Aichi-ken (JP); Akio Saiki, Aichi-ken (JP); Kazuo Kobayashi, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 411 days.

(21) Appl. No.: 13/399,395

(22) Filed: Feb. 17, 2012

(65) Prior Publication Data

US 2012/0213648 A1 Aug. 23, 2012

(30) Foreign Application Priority Data

Feb. 22, 2011 (JP) ..... 2011-036390

(51) Int. Cl.

| | |
|---|---|
| ***B01D 45/12*** | (2006.01) |
| ***F04C 29/02*** | (2006.01) |
| ***F04C 18/02*** | (2006.01) |
| *F04C 27/00* | (2006.01) |
| *F04C 29/12* | (2006.01) |

(52) U.S. Cl.

CPC ..... *F04C 29/026* (2013.01); *F04C 18/0215* (2013.01); *F04C 27/008* (2013.01); *F04C 29/12* (2013.01)

USPC ..... 55/459.4; 55/447; 55/456; 55/459.1; 55/459.2; 55/459.3; 55/459.5; 96/216; 95/261

(58) Field of Classification Search

USPC ..... 55/447, 456, 459.1–459.5; 96/216; 418/55.1–55.6, 57, 97, 270, DIG. 1; 95/261

See application file for complete search history.

(56) References Cited

U.S. PATENT DOCUMENTS

| | | | | |
|---|---|---|---|---|
| 6,237,362 | B1 * | 5/2001 | Jang | 62/469 |
| 2011/0146215 | A1 * | 6/2011 | Lee et al. | 55/456 |

FOREIGN PATENT DOCUMENTS

| | | |
|---|---|---|
| JP | 2003-336588 | 11/2003 |
| JP | 2004-52710 | 2/2004 |
| JP | 2005-54745 | 3/2005 |
| JP | 2005-188394 | 7/2005 |
| JP | 2006-132487 | 5/2006 |
| JP | 2007-9776 | 1/2007 |

OTHER PUBLICATIONS

Japan Office action, mail date is Feb. 19, 2013.

* cited by examiner

*Primary Examiner* — Dung H Bui

(74) *Attorney, Agent, or Firm* — Greenblum & Bernstein, P.L.C.

(57) ABSTRACT

A compressor compressing a fluid including lubricating oil includes, on the discharge side thereof, a first separation chamber for separating the lubricating oil by generating a swirling flow in the fluid. The first separation chamber includes: a circumferential wall; an inflow port that is formed in the circumferential wall and causes the fluid to flow into the first separation chamber; and a guiding plate extending from the circumferential wall. The guiding plate extends so as to face the inflow port in a direction where the fluid flows from the inflow port into the first separation chamber, and so as to deflect the fluid flow from the inflow port to guide it along an inner circumferential surface of the circumferential wall.

7 Claims, 12 Drawing Sheets

COMPRESSOR

BACKGROUND OF THE INVENTION

1. Field of the Invention

The present invention relates to a compressor.

2. Description of the Art

In some compressors, lubricating oil is supplied to the suction side of the compressor to lubricate movable parts of the compression mechanism serving to compress a fluid, and in such compressors, the lubricating oil is contained in a refrigerant. Where the compressor is provided in a refrigeration circuit, when the refrigerant including the lubricating oil is discharged from the compressor, the lubricating oil flowing out together with the refrigerant adheres to an evaporator, etc., in the refrigeration circuit, thereby degrading heat exchange in the refrigeration circuit. In order to prevent such decrease in heat exchange efficiency, the lubricating oil is separated from the refrigerant on the discharge side of the compressor and returned into the compressor. The returned lubricating oil is used to lubricate sliding portions and sealing portions (shaft seal and the like) of the drive mechanism of the compressor and, for example in the case of a scroll compressor, to lubricate sliding portions between a movable scroll and a fixed scroll.

For example, Japanese Patent Application Laid-open No. 2005-188394 describes a scroll compressor having a separation chamber for separating the lubricating oil contained in the refrigerant. In the above compressor, the separation chamber is formed by arranging a recess provided at one end side of the first housing and a recess provided in the fixed scroll opposite each other. A separation tube extending in the vertical direction is provided inside the separation chamber. As a result, the compressed refrigerant is discharged from the refrigerant discharge chamber through a communicating hole provided in the separation chamber, and the discharged refrigerant flows so as to swirl along the inner wall of the separation chamber, thereby enabling centrifugal separation of the lubricating oil contained therein. The swirling refrigerant is discharged from the lower end of the separation tube into the refrigerant storage chamber and then discharged to the outside from the refrigerant discharge port.

However, in the compressor described in Japanese Patent Application Laid-open No. 2005-188394, the separation tube is put between and held by the first housing and fixed scroll. Therefore, a problem is that the installation dimensions required to prevent the separation tube from falling out are severely restricted and the structure becomes complex. Yet another problem is that the assembly operation requires time and effort.

SUMMARY OF THE INVENTION

The present invention has been created to resolve the above-described problems and it is an object of the present invention to provide a compressor with a simplified structure of the separation chamber for separating the lubricating oil contained in the refrigerant that is compressed.

In order to resolve these problems, the present invention provides a compressor which compresses a fluid including a lubricating oil and has, on a discharge side of the compressor, a separation chamber for separating the lubricating oil by generating a swirling flow in the fluid, wherein the separation chamber has: a circumferential wall forming the separation chamber; an inflow port that is formed in the circumferential wall of the separation chamber and causes the fluid to flow into the separation chamber; and a guiding plate that extends from the circumferential wall of the separation chamber, the guiding plate extending so as to face the inflow port in a direction in which the fluid flows from the inflow port into the separation chamber, and so as to deflect the flow of the fluid from the inflow port to guide the flow along an inner circumferential surface of the circumferential wall.

DESCRIPTION OF THE PREFERRED EMBODIMENTS

An embodiment of the present invention will be explained below with reference to the appended drawings.

First Embodiment

The construction of a compressor 101 according to a first embodiment of the present invention will be explained below with reference to FIGS. 1 to 4. In the example explained in the below-described embodiment, a scroll compressor, which is provided in a refrigeration circuit installed on a vehicle and which sucks, compresses and then discharges a refrigerant circulating in the refrigeration circuit, is used as the compressor 101.

Figure 1:
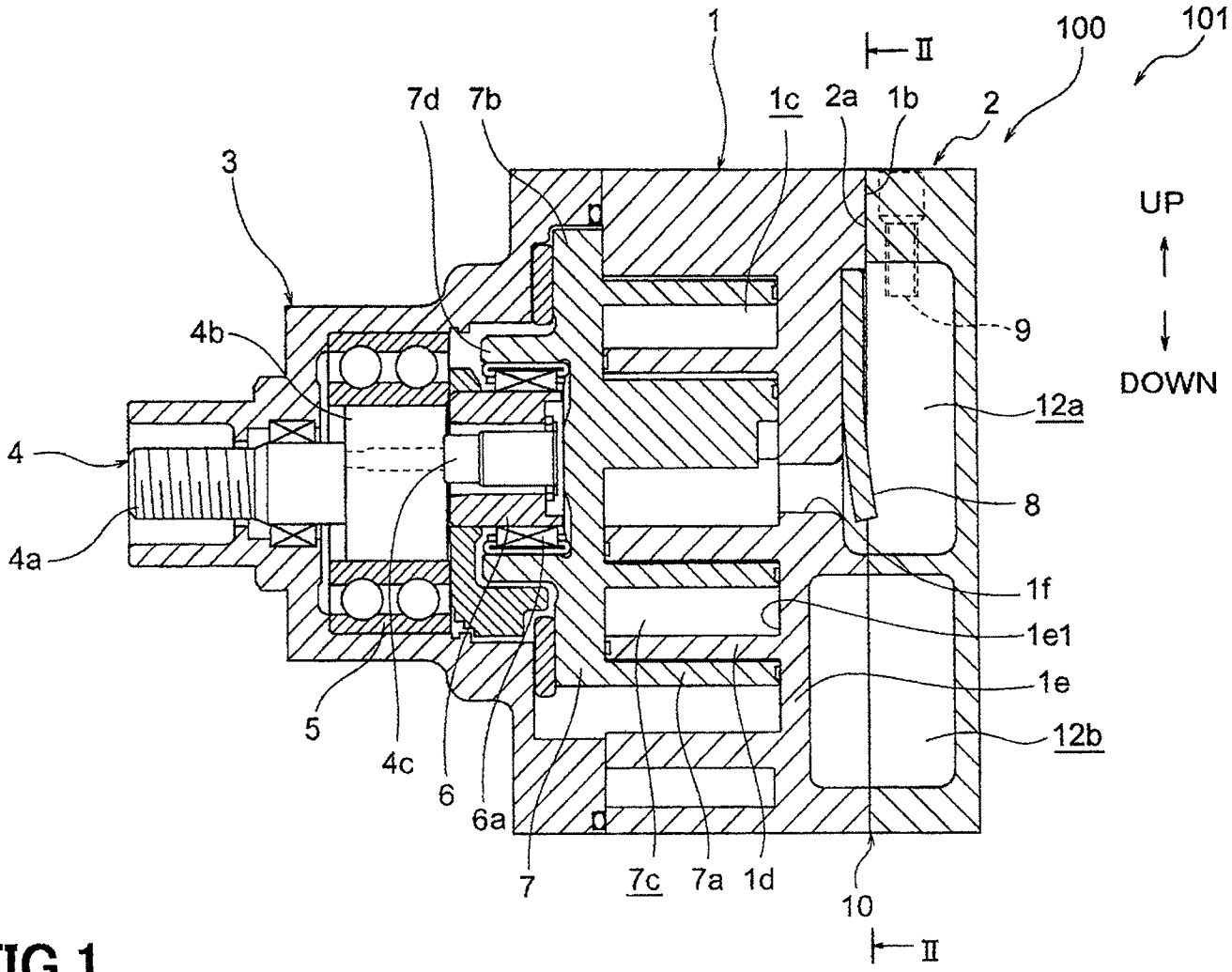
FIG. 1 is a schematic sectional side view illustrating the construction of a compressor according to a first embodiment of the present invention.

Referring to FIG. 1, the compressor 101 includes a rear housing 2 and a front housing 3 on both sides of a shell 1 which is positioned in the center of the housings and has a box-like shape that is open at one face. The shell 1, rear housing 2 and front housing 3 are joined together by using bolts (not shown in the figure) or the like. A sealing material is inserted between the front housing 3 and the shell 1 and a gasket 10 is inserted between the shell 1 and the rear housing 2 in order to prevent the leakage of fluid from the interior of the compressor 101.

The shell 1, rear housing 2 and front housing 3 are housing-forming members and integrally constitute a housing 100 which is the casing of the compressor 101.

The compressor 101 includes a movable scroll 7 in an interior 1*c* of the shell 1. The movable scroll 7 is formed by a plate-like base plate 7*b* extending in a direction perpendicular to the direction from the front housing 3 to the shell 1, and a spiral wall 7*a* protruding from the base plate 7*b* into the interior 1*c* in a direction toward the rear housing 2. The spiral wall 7*a* extends spirally on the base plate 7*b*.

The shell 1 forms a fixed scroll opposite the movable scroll 7. Thus, a base plate 1*e* of the shell 1 extends so as to face the base plate 7*b* of the movable scroll 7 and also serves as a base plate of the fixed scroll. A spiral wall 1*d* is formed to protrude from an inner surface 1*e*1 on the interior 1*c* side of the base plate 1*e* of the fixed scroll toward the base plate 7*b* of the movable scroll 7. The spiral wall 1*d* extends spirally on the inner surface 1*e*1. The base plate 1*e* and the spiral wall 1*d* constitute the fixed scroll.

The movable scroll 7 is disposed so that the spiral wall 7*a* thereof is fitted between the sections of the spiral wall 1*d* of the shell 1. By bringing the spiral wall 7*a* of the movable scroll 7 into contact with the spiral wall 1*d* of the shell 1, it is possible to form a closed crescent-shaped compression chamber 7*c*.

In the movable scroll 7, a cylindrical shaft support 7*d* is formed to protrude from the base plate 7*b* to the side opposite to the spiral wall 7*a* side.

Further, the compressor 101 includes a drive shaft 4 supported by a bearing 5 on the front housing 3 in the shaft support 7*d* side of the movable scroll 7. The drive shaft 4 is constituted by a large-diameter portion 4*b* supported by the bearing 5, a rod-shaped connection portion 4*a* that extends from the large-diameter portion 4*b* to the side opposite to the movable scroll 7 side and is connected by a clutch to a drive apparatus such as an engine of the vehicle (not shown in the figure), and an eccentric shaft portion 4*c* extending from the large-diameter portion 4*b* into the shaft support 7*d* of the movable scroll 7.

The central axis of the connection portion 4*a* matches that of the large-diameter portion 4*b*, and the central axis of the eccentric shaft portion 4*c* is offset with respect to the connection portion 4*a* and large-diameter portion 4*b*. The eccentric shaft portion 4*c* is rotatably mated with the shaft support 7*d* by a bushing 6 and a bearing 6*a* on the outer circumference thereof.

The compressor 101 also includes a discharge chamber 12*a* and an oil storage chamber 12*b* formed inside the compressor by the shell 1 and the rear housing 2. The discharge chamber 12*a* and the oil storage chamber 12*b* are formed on the side opposite to the movable scroll 7 side with respect to the base plate 1*e* of the shell 1, and the discharge chamber 12*a* is disposed so as to be positioned above the oil storage chamber 12*b* in the gravity force direction. Further the discharge chamber 12*a* communicates with the interior is of the shell 1 via a discharge hole 1*f* passing through the base plate 1*e* of the shell 1.

A discharge valve mechanism 8 that opens and closes the discharge hole 1*f* is provided inside the discharge chamber 12*a*, and a discharge passage 9 communicating the discharge chamber 12*a* with a refrigeration circuit (not shown in the figure) located outside the compressor 101 is provided through the rear housing 2.

The oil storage chamber 12*b* communicates with the suction side of the compressor 101, and lubricating oil of the oil storage chamber 12*b* is supplied to sliding portions of the drive mechanism (eccentric shaft portion 4*c*, bushing 6, and the like), seal portions (shaft seal and the like), and sliding portions between the movable scroll 7 and the fixed scroll, etc. The lubricating oil is supplied between the movable scroll 7 and the fixed scroll not only to ensure smooth sliding between the two scrolls, but also to increase sealing ability between the two scrolls, increase hermeticity of the compression chamber 7*c*, and form the compression chamber 7*c* as a tightly closed space.

In the present description, the direction from the oil storage chamber 12*b* toward the discharge chamber 12*a* in the figure will be referred to as an upward direction and the direction from the discharge chamber 12*a* toward the oil storage chamber 12*b* will be referred to as a downward direction. Further, the compressor 101 shown in the figure illustrates a state in which the compressor is disposed in a vehicle or the like, and in this state, the upward and downward directions correspond to directions against and along the force of gravity.

Figure 2:
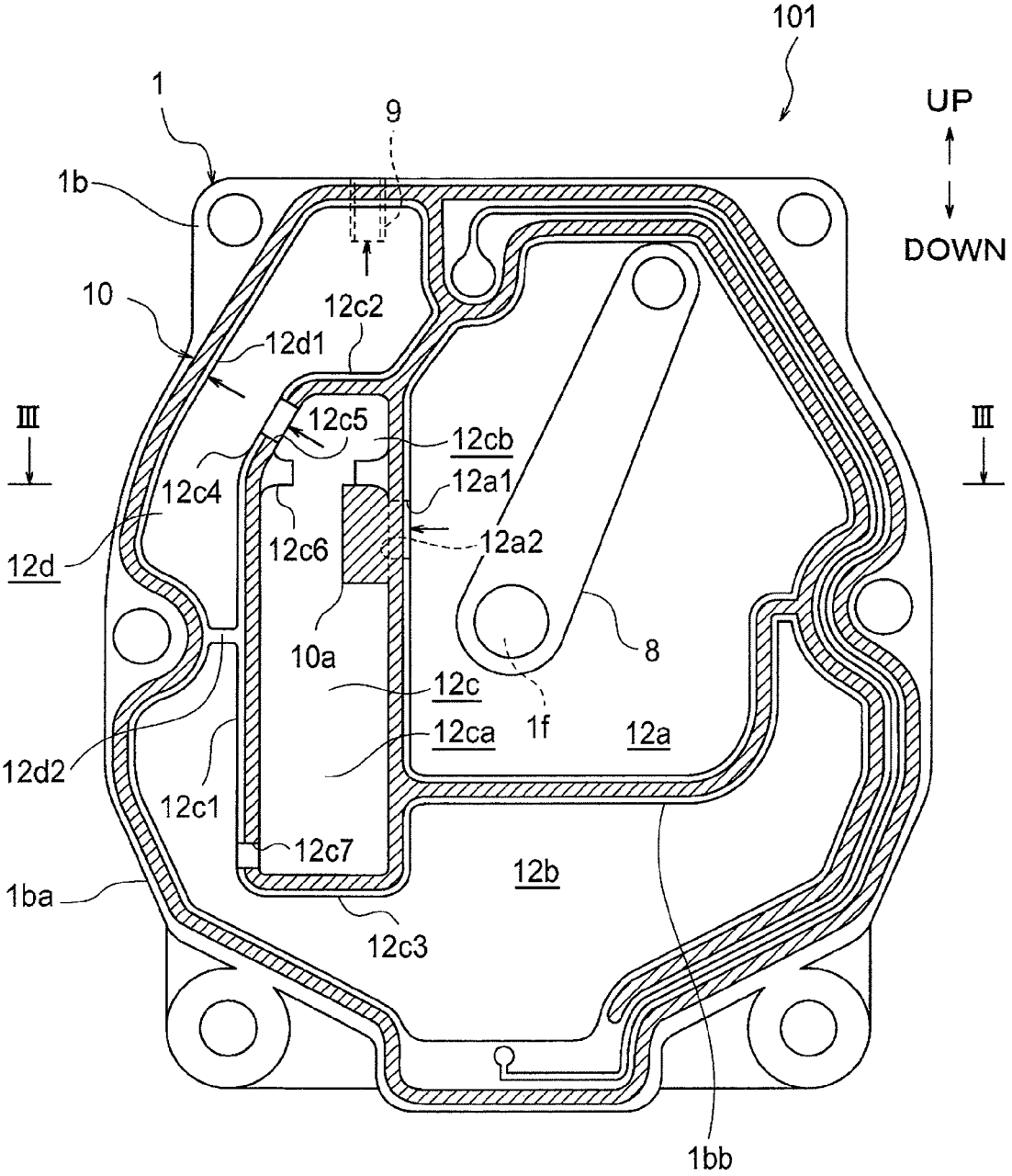
FIG. 2 is a schematic drawing illustrating a cross section taken along the II-II line in FIG. 1.

FIG. 2 shows a cross section taken along the II-II line in FIG. 1, that is, illustrates a side portion 1*b* of the shell 1 formed by the surface mating with the rear housing 2 that is viewed from the rear housing 2 side.

In the side portion 1*b*, an outer circumferential wall 1*ba* surrounding the outer circumference of the side portion 1*b* and an inner wall 1*bb* partitioning chambers on the inside of the outer circumferential wall 1*ba* are formed so as to protrude from the base plate 1*e*.

The inner wall 1*bb* together with the outer circumferential wall 1*ba* define part of the discharge chamber 12*a* and also define part of the oil storage chamber 12*b* below the discharge chamber 12*a*. Further, the inner wall 1*bb* defines half of the first oil separation chamber 12*c* that is adjacent to the discharge chamber 12*a* and communicates therewith. The inner wall 1*bb* together with the outer circumferential wall 1*ba* also define part of a second oil separation chamber 12*d* that is adjacent to the first oil separation chamber 12*c* and communicates with the first oil separation chamber 12*c* and the oil storage chamber 12*b*. The first oil separation chamber 12*c* in the shell 1 is formed in a substantially semicylindrical shape.

Further, in a side portion 2*a* (see FIG. 1) of the rear housing 2 (see FIG. 1) formed by the surface mating with the shell 1, the rear housing 2 (see FIG. 1) also has an outer circumferential wall and an inner wall (not shown in the figure) that are formed to mate with the outer circumferential wall 1*ba* and inner wall 1*bb* of the shell 1 when assembled with the shell 1. In the rear housing 2, similarly to the shell 1, the outer circumferential wall and inner wall form the remaining portions of the discharge chamber 12*a*, oil storage chamber 12*b*, first oil separation chamber 12*c* and second oil separation chamber 12*d*, and the first oil separation chamber 12*c* in the rear housing 2 is formed substantially symmetrically with the first oil separation chamber 12*c* in the shell 1.

Where the shell 1 is joined to the rear housing 2 (see FIG. 1), the discharge chamber 12*a*, oil storage chamber 12*b*, first oil separation chamber 12*c* and second oil separation chamber 12*d* that are only partially formed in the shell 1 take a complete shape. In this case, the first oil separation chamber 12*c* takes a substantially cylindrical shape. Further, when the shell 1 and the rear housing 2 are joined together, the sheet-like gasket 10 is provided on the outer circumferential wall 1*ba* and the inner wall 1*bb*, and the gasket 10 is inserted and held between the shell 1 and the rear housing 2.

Further, the inner wall 1*bb* in the shell 1 forms a semicylindrical side circumferential wall 12*c*1 forming half of a cylindrical side wall of the first oil separation chamber 12*c*, a half-moon bottom wall 12*c*3 forming half of a disk-shaped bottom of the first oil separation chamber 12*c*, a half-moon upper wall 12*c*2 forming half of a disk-shaped top of the first oil separation chamber 12*c*, and a tapered wall 12*c*4 forming part of a tapered portion joining together the upper wall 12*c*2 and the side circumferential wall 12*c*1 of the first oil separation chamber 12*c*. Thus, the inner wall 1*bb* in the shell 1 surrounds half of the first oil separation chamber 12*c*. The tapered wall 12*c*4 is sloped to upwardly taper the first oil separation chamber 12*c* and faces the outer circumferential wall 1*ba*. Herein, the side circumferential wall 12*c*1 constitutes a circumferential wall forming member of the first oil separation chamber 12*c*.

Figure 3:
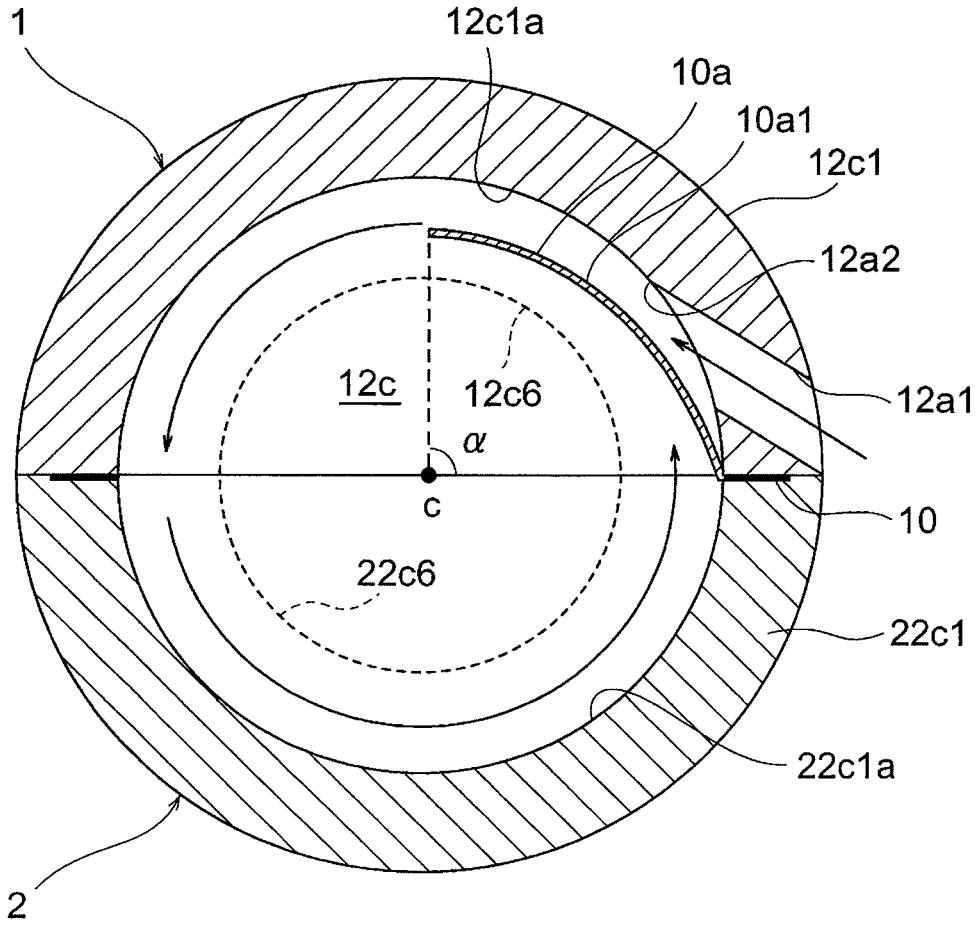
FIG. 3 is a schematic drawing illustrating a cross section of the first oil separation chamber taken along the line in FIG. 2.

Further, in the first oil separation chamber 12*c*, an inflow hole 12*a*1, which communicates the discharge chamber 12*a* with the first oil separation chamber 12*c* and opens inside the first oil separation chamber 12*c* at the inflow port 12*a*2, is formed in the side circumferential wall 12*c*1 at the discharge chamber 12*a* side. The inflow hole 12*a*1 is formed at a position farther in the depth direction than the gasket 10 (on the figure). Referring to FIG. 3, the inflow hole 12*a*1 is positioned close to the gasket 10 inserted between the shell 1 and the rear housing 2 and at a distance from the gasket 10. Further, the inflow hole 12*a*1 is formed along the direction offset from the central axis (c) of the first oil separation chamber 12*c* and so as to guide the fluid flowing in from the inflow port 12*a*2 in the tangential direction of an inner circumferential surface 12*c*1*a* of the first oil separation chamber 12*c*.

Returning to FIG. 2, on the inner side of the circumferential wall 12*c*1 in the first oil separation chamber 12*c*, a protruding portion 12*c*6 having a semicircular band-like shape protrudes adjacently to the top of the inflow port 12*a*2 and inward so as to extend along the inner circumferential surface 12*c*1*a* (see FIG. 3). The protruding portion 12*c*6 constitutes a throttle portion that restricts the flow of the fluid in the first oil separation chamber 12*c* from a lower space 12*ca* located below the protruding portion 12*c*6 to an upper space 12*cb* above the protruding portion 12*c*6.

An outflow hole 12*c*5 communicating the upper space 12*cb* of the first oil separation chamber 12*c* with the second oil separation chamber 12*d* is formed in the tapered wall 12*c*4 of the first oil separation chamber 12*c* at a location facing the outer circumferential wall 1*ba*. Herein, the outflow hole 12*c*5 constitutes an outflow port.

An oil discharge hole 12*c*7 communicating the lower space 12*ca* of the first oil separation chamber 12*c* with the oil storage chamber 12*b* is formed in the vicinity of the bottom wall 12*c*3 in the side circumferential wall 12*c*1 of the first oil separation chamber 12*c*.

Further, the discharge passage 9 is formed in the rear housing 2 (see FIG. 1) at a position above the first oil separation chamber 12*c* and communicates the second oil separation chamber 12*d* with the refrigeration circuit (not shown in the figure) located outside the compressor 101. The refrigeration circuit is provided with the compressor 101 and also a condenser, an expansion valve and an evaporator (not shown in the figure).

The second oil separation chamber 12*d* communicates with the oil storage chamber 12*b* through a communication path 12*d*2 formed below the second oil separation chamber 12*d* by a portion of the inner wall 1*bb* where the gasket 10 is not provided.

Further, in the first oil separation chamber 12*c* of the shell 1, the gasket 10 is provided such as to surround the first oil separation chamber 12*c*, except the outflow hole 12*c*5 and the oil discharge hole 12*c*7. In the gasket 10, a plate-like guiding plate 10*a* extending from the side of the inflow port 12*a*2 to be adjacent to the lower part of the protruding portion 12*c*6 is formed in a protruding condition integrally with the gasket 10 from the same material as the gasket. For example, the guiding plate 10*a* can be formed integrally with the gasket 10 by press punching.

Referring to FIG. 3, the circumference of the first oil separation chamber 12*c* is formed by the semicylindrical side circumferential wall 12*c*1 formed integrally with the shell 1 and a semicylindrical side circumferential wall 22*c*1 formed integrally with the rear housing 2. The cylindrical shape of the first oil separation chamber 12*c* is formed by the semicylindrical inner circumferential surface 12*c*1*a* of the side circumferential wall 12*c*1 and the semicylindrical inner circumferential surface 22*c*1*a* of the side circumferential wall 22*c*1. Herein, the circumferential wall forming member of the first oil separation chamber 12*c* is constituted by the side circumferential wall 22*c*1, and the circumferential wall of the first oil separation chamber 12*c* is constituted by the side circumferential walls 12*c*1 and 22*c*1.

Further, the protruding portion 12*c*6 protrudes from the inner circumferential surface 12*c*1*a* of the side circumferential wall 12*c*1, the semicircular protruding portion 22*c*6 protrudes from the inner circumferential surface 22*c*1*a* of the side circumferential wall 22*c*1, and the protruding portions 12*c*6 and 22*c*6 form an annular protruding portion above the inflow port 12*a*2.

The guiding plate 10*a* extends from the gasket 10 inserted and held between the side circumferential walls 12*c*1 and 22*c*1, so as to face and cover the inflow hole 12*a*1. Further, the guiding plate 10*a* also extends, so that a flat surface 10*a*1 of the guiding plate 10*a* faces the inner circumferential surface 12*c*1*a* of the side circumferential wall 12*c*1 of the first oil separation chamber 12*c*, in the direction along the circumferential direction of the inner circumferential surface 12*c*1*a*, which is the direction along the inflow direction through the inflow hole 12*a*1 to the inner circumferential surface 12*c*1*a*, and the guiding plate 10*a* is also curved along the inner circumferential surface 12*c*1*a*. In other words, the guiding plate 10*a* extends so as to face the inflow port 12*a*2 in the axial direction of the hole, which is the inflow direction of the inflow hole 12*a*1, and the direction from the inflow port 12*a*2 toward the central axis (c) of the cylinder of the first oil separation chamber 12*c*. Further, the guiding plate 10*a* is formed so as to cover the inner circumferential surface 12*c*1*a* within a range with a central angle $\alpha$ in the central axis (c) of the transverse cross section of the first oil separation chamber 12*c*. In the present embodiment, the central angle $\alpha$ is close to 90°, so that the fluid flowing in from the inflow port 12*a*2 flows along the inner circumferential surface 12*c*1*a*.

Figure 4:
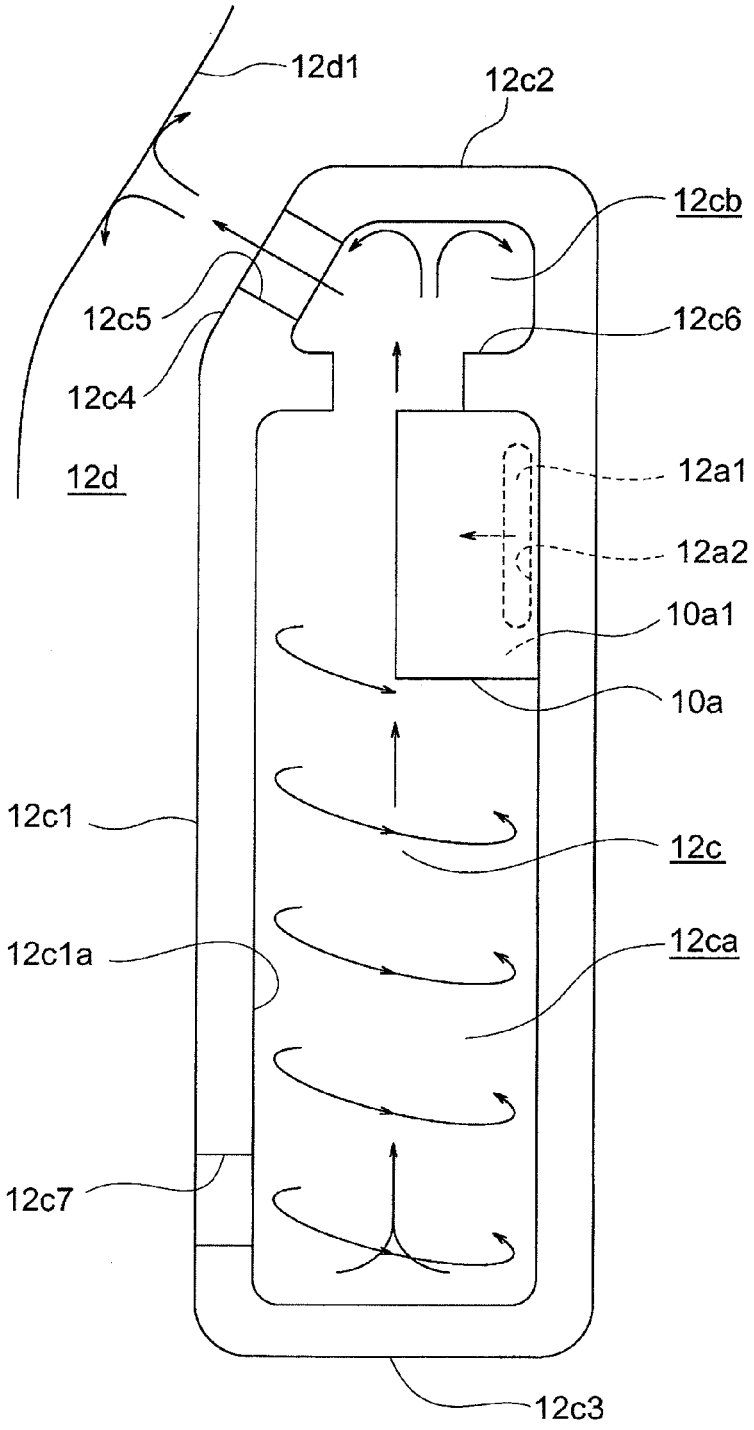
FIG. 4 is a schematic sectional view illustrating on an enlarged scale the first oil separation chamber shown in FIG. 2 and the periphery thereof.

Referring to FIG. 4 showing the first oil separation chamber 12*c* and the periphery thereof in FIG. 2 on an enlarged scale and in a state in which the gasket 10 is removed, the guiding plate 10*a* is formed to a length in the vertical direction such as to cover the inflow port 12*a*2.

As follows from above, the discharge chamber 12*a*, oil storage chamber 12*b*, first oil separation chamber 12*c* having the guiding plate 10*a* inside thereof and second oil separation chamber 12*d* are formed by assembling the shell 1, rear housing 2 and gasket 10.

The operation of the compressor 101 according to the first embodiment of the present invention will be explained below with reference to FIGS. 1 to 4.

Referring to FIG. 1, where the rotational drive power of the engine of the vehicle is transmitted by the clutch (not shown in the figure) to the connection portion 4*a* of the drive shaft 4 and the connection portion 4*a* is rotated, the large-diameter portion 4*b* and the eccentric shaft portion 4*c* rotate together with the connection portion 4*a*. In this case, the large-diameter portion 4*b* rotates coaxially with the connection portion 4*a*, and the eccentric shaft portion 4*c* orbits around the rotation central axis of the connection portion 4*a*. The movable scroll 7, which is connected with the orbiting eccentric shaft portion 4*c* by the shaft support 7*d*, revolves about the rotation central axis of the connection portion 4*a*.

As a result, the compression chamber 7*c* that decreases in volume following the revolution of the movable scroll 7 is formed between the spiral wall 7*a* of the movable scroll 7 and the spiral wall 1*d* of the shell 1 constituting the fixed scroll. Further, in the process in which the volume of the compression chamber 7*c* changes, the refrigerant is sucked in from the intake hole (not shown in the figure) into the compression chamber 7*c*, the refrigerant is compressed in the compression chamber 7*c*, and the compressed refrigerant is discharged from the discharge hole 1*f*. The compressed refrigerant discharged from the discharge hole 1*f* flows into the discharge chamber 12*a*.

Further, in this process, the lubricating oil located in the oil storage chamber 12*b* is supplied to the suction side of the compression chamber 7*c* in order to lubricate the movable members, and the supplied lubricating oil is discharged to the discharge chamber 12*a* in a state in which the lubricating oil is included in the form of a mist in the compressed refrigerant.

Further, referring to FIG. 2, the compressed refrigerant including the lubricating oil and discharged from the discharge hole 1*f* into the discharge chamber 12*a* is discharged to the lower space 12*ca* of the first oil separation chamber 12*c* through the inflow hole 12*a*1.

Referring to both FIG. 3 and FIG. 4, the compressed refrigerant discharged from the inflow port 12*a*2 into the lower space 12*ca* is guided by the guiding plate 10*a* of the gasket 10 so that the flow of the compressed refrigerant is deflected. As a result, the compressed refrigerant flows along the cylindrical inner circumferential surface 12*c*1*a* of the first oil separation chamber 12*c*, and a swirling flow advancing in the counterclockwise direction (on FIG. 3) is generated. Further, the flow of the compressed refrigerant discharged from the inflow port 12*a*2 is restricted in the upward direction from the inflow port 12*a*2 by the band-like protruding portion 12*c*6 located thereabove and having an annular shape. Therefore, the swirling flow of the compressed refrigerant advances toward the bottom wall 12*c*3, while rotating along the inner circumferential surface 12*c*1*a*. In this case, the lubricating oil contained in the compressed refrigerant is centrifugally separated as the lubricating oil rotates together with the compressed refrigerant and the separated lubricating oil adheres to the inner circumferential surface 12*c*1*a*. The adhered lubricating oil flows down and accumulates on the bottom wall 12*c*3. The lubricating oil accumulated on the bottom wall 12*c*3 flows out through the oil discharge hole 12*c*7 into the oil storage chamber 12*b* (see FIG. 2) located outside the first oil separation chamber 12*c*.

Further, the swirling flow of the compressed refrigerant that has reached the bottom wall 12*c*3 collides with the bottom wall 12*c*3, the direction thereof changes into the upward direction, and the compressed refrigerant flows toward the upper space 12*cb* through the center of the lower space 12*ca*. In this case, the guiding plate 10*a* cuts off the refrigerant immediately after the refrigerant has flown in from the inflow port 12*a*2 from the refrigerant flowing through the lower space 12*ca* in the upward direction. Therefore, the two refrigerants flow without disturbing the flow of each other. The compressed refrigerant flowing upward flows into the upper space 12*cb* through the gap formed with the protruding portion 12*c*6, collides with the upper wall 12*c*2 of the first oil separation chamber 12*c*, thereafter changes the flow direction thereof, and flows out to the second oil separation chamber 12*d* through the outflow hole 12*c*5.

In this process, in the upper space 12*cb*, the separation of the lubricating oil that has not been separated and remains included in the compressed refrigerant is enhanced by collision of the compressed refrigerant with the upper wall 12*c*2, the amount of the lubricating oil contained in the compressed refrigerant is further reduced, and the compressed refrigerant with the reduced amount of lubricating oil is discharged into the second oil separation chamber 12*d*. Herein, the upper wall 12*c*2 constitutes the collision wall portion.

Referring to both FIG. 2 and FIG. 4, the compressed refrigerant discharged into the second oil separation chamber 12*d* exits the outflow hole 12*c*5, immediately collides with an opposite wall portion 12*d*1 that faces the outflow hole 12*c*5 and is a part of the outer circumferential wall 1*ba* surrounding the second oil separation chamber 12*d*. The flow direction of the compressed refrigerant thus changes and is discharged to the outside of the compressor 101 through the discharge passage 9. In this case, the separation of the lubricating oil that has not been separated and remains included in the compressed refrigerant is enhanced by collision of the compressed refrigerant with the opposite wall portion 12*d*1 and the amount of the lubricating oil contained in the compressed refrigerant is further reduced. The lubricating oil separated from the compressed refrigerant adheres to the inner surface of the second oil separation chamber 12*d*, and the adhered lubricating oil flows down and flows into the oil storage chamber 12*b* through the communication path 12*d*2. Herein, the opposite wall portion 12*d*1 constitutes the collision wall portion.

As shown hereinabove, before the compressed refrigerant discharged from the discharge hole 1*f* is discharged to the outside of the compressor 101, the compressed refrigerant is subjected to three separation actions, namely, centrifugal separation in the lower space 12*ca* of the first oil separation chamber 12*c*, collision with the upper wall 12*c*2 in the upper space 12*cb* of the first oil separation chamber 12*c*, and collision with the opposite wall portion 12*d*1 in the second oil separation chamber 12*d*, thereby ensuring the separation and removal of the lubricating oil contained therein.

As described hereinabove, the compressor 101 in accordance with the present invention is a compressor which compresses a refrigerant including a lubricating oil and has, on a discharge side of the compressor 101, a first oil separation chamber 12*c* for separating the lubricating oil by generating a swirling flow in the refrigerant. The first oil separation chamber 12*c* has cylindrical side circumferential walls 12*c*1 and 22*c*1 forming the first oil separation chamber 12*c*, an inflow port 12*a*2 that is formed in the side circumferential wall 12*c*1 of the first oil separation chamber 12*c* and causes the refrigerant to flow into the first oil separation chamber 12*c*, and a guiding plate 10*a* that extends from the side circumferential wall 12*c*1 of the first oil separation chamber 12*c*. The guiding plate 10*a* extends so as to face the inflow port 12*a*2 in the direction in which the refrigerant flows from the inflow port 12*a*2 into the first oil separation chamber 12*c*, and so as to deflect the flow of the refrigerant from the inflow port 12*a*2 to guide the flow along the inner circumferential surface 12*c*1*a* of the side circumferential wall 12*c*1.

In this case, the guiding plate 10*a* generates a swirling flow along the side circumferential walls 12*c*1 and 22*c*1 in the refrigerant flowing from the inflow port 12*a*2 into the first oil separation chamber 12*c*. As a result, the lubricating oil contained in the refrigerant is moved in a swirling manner together with the refrigerant whereby the lubricating oil is effectively separated centrifugally. Further, since the compressor 101 has a structure of only providing the guiding plate 10*a* in the first oil separation chamber 12*c*, the structure thereof is simple. In addition, the cross-sectional dimension of the side circumferential walls 12*c*1 and 22*c*1 of the first oil separation chamber 12*c* in the direction perpendicular to the axial direction thereof, that is, in the diametrical direction, can be reduced by comparison with the case in which a centrifugal separation tube or the like is provided. Therefore, the structure of the first oil separation chamber 12*c* in the compressor 101 can be simplified and reduced in size and high separation capacity can be ensured with respect to the lubricating oil contained in the refrigerant.

Further, the guiding plate 10*a* cuts off the refrigerant immediately after the refrigerant has flown in from the inflow port 12*a*2 from the refrigerant flowing through the center of the swirling flow toward the upper wall 12*c*2 after collision with the bottom wall 12*c*3 of the first oil separation chamber 12*c*. Therefore, the flows can be prevented from disturbing each other.

Further, no centrifugal separation tube or the like for causing the refrigerant to rotate and flow out of the first oil separation chamber 12*c* is provided inside the first oil separation chamber 12*c*. Where a tube or the like is provided inside the first oil separation chamber 12*c*, the tube diameter is restricted by the diametrical dimension of the first oil separation chamber 12*c*, and pressure loss caused by the tube is generated in the refrigerant. However, in the first oil separation chamber 12*c* that has no tube or the like inside thereof, pressure loss created in the flowing refrigerant can be reduced.

Furthermore, in the compressor 101, the guiding plate 10*a* extends along the circumferential direction of the inner circumferential surface 12*c*1*a* so as to face the inner circumferential surface 12*c*1*a* of the side circumferential wall 12*c*1. As a result, the guiding plate 10*a* can effectively generate a swirling flow along the inner circumferential surfaces 12*c*1*a* and 22*c*1*a* in the refrigerant flowing from the inflow port 12*a*2 into the first oil separation chamber 12*c*.

Further, in the compressor 101, the first oil separation chamber 12*c* has the outflow hole 12*c*5 that is provided above the inflow port 12*a*2 and causes the refrigerant to flow out from the interior of the first oil separation chamber 12*c* and protruding portions 12*c*6 and 22*c*6 that protrude from the side circumferential walls 12*c*1 and 22*c*1 between the inflow port 12*a*2 and outflow hole 12*c*5 and reduce the cross-sectional area of the first oil separation chamber 12*c*. As a result, the refrigerant flowing from the inflow port 12*a*2 into the first oil separation chamber 12*c* is prevented by the protruding portions 12*c*6 and 22*c*6 from flowing from the inflow port 12*a*2 directly toward the outflow hole 12*c*5 and a swirling flow is easily generated inside the first oil separation chamber 12*c*.

Further, the side circumferential wall of the first oil separation chamber 12*c* is formed by a plurality of side circumferential walls 12*c*1 and 22*c*1, the first oil separation chamber 12*c* has the gasket 10 between the side circumferential walls 12*c*1 and 22*c*1, and the guiding plate 10*a* is formed integrally with the gasket 10 so as to extend from the gasket 10. In addition, the compressor 101 is provided with the housing 100 that is formed by the shell 1, rear housing 2 and front housing 3, which are housing forming members, and constitutes the casing. The side circumferential walls 12*c*1 and 22*c*1 of the first oil separation chamber 12*c* are provided correspondingly to the shell 1 and rear housing 2, respectively, and formed integrally with the corresponding shell 1 and rear housing 2. As a result, the first oil separation chamber 12*c* is formed by assembling the rear housing 2 with the shell 1. In this case, the guiding plate 10*a* is arranged inside the first oil separation chamber 12*c* by inserting the gasket 10 between the shell 1 and the rear housing 2 and between the side circumferential walls 12*c*1 and 22*c*1. Therefore, the guiding plate 10*a* is arranged only by the operation of assembling the shell 1, rear housing 2 and gasket 10. As a consequence, the number of assembling operations can be reduced and the costs can be also reduced. The guiding plate 10*a* may be formed by attaching an additional plate.

The compressor 101 is further provided with a second oil separation chamber 12*d* that communicates with the first oil separation chamber 12*c* via the outflow hole 12*c*5. The second oil separation chamber 12*d* has the opposite wall portion 12*d*1 for causing the refrigerant that has flown out from the outflow hole 12*c*5 to collide at the position facing the outflow hole 12*c*5. In this case, since the refrigerant that has flown out from the first oil separation chamber 12*c* collides with the opposite wall portion 12*d*1, separation of the lubricating oil that may still be contained in the refrigerant is enhanced and the refrigerant can be discharged from the compressor 101 in a state with a further reduced content of the lubricating oil.

In the compressor 101, the first oil separation chamber 12*c* has the lower space 12*ca* located below the protruding portions 12*c*6 and 22*c*6 and the upper space 12*cb* located above the protruding portions 12*c*6 and 22*c*6. The upper wall 12*c*2 for causing collision of the refrigerant flowing from the lower space 12*ca* into the upper space 12*cb* and for changing the flow direction of the refrigerant is further provided in the upper space 12*cb*. In this case, the refrigerant from which the lubricating oil has been separated by centrifugal separation in the lower space 12*ca* collides with the upper wall 12*c*2 in the upper space 12*cb*. As a result, even when the lubricating oil is still contained in the refrigerant, the separation thereof is enhanced and the refrigerant is discharged from the first oil separation chamber 12*c* in a state with a reduced content of lubricating oil.

Second Embodiment

In a compressor 201 according to a second embodiment of the present invention, a lower guiding plate portion 212*c*8 that extends from the side circumferential wall 12*c*1 along the circumferential direction of the inner circumferential surface 12*c*1*a* of the side circumferential wall 12*c*1 is provided below the inflow port 12*a*2 in the first oil separation chamber 12*c* of the compressor 101 of the first embodiment.

In the below-described embodiment, reference symbols identical to those in the above-described figures denote identical or similar constituent elements and detailed explanation thereof is herein omitted.

Figure 5:
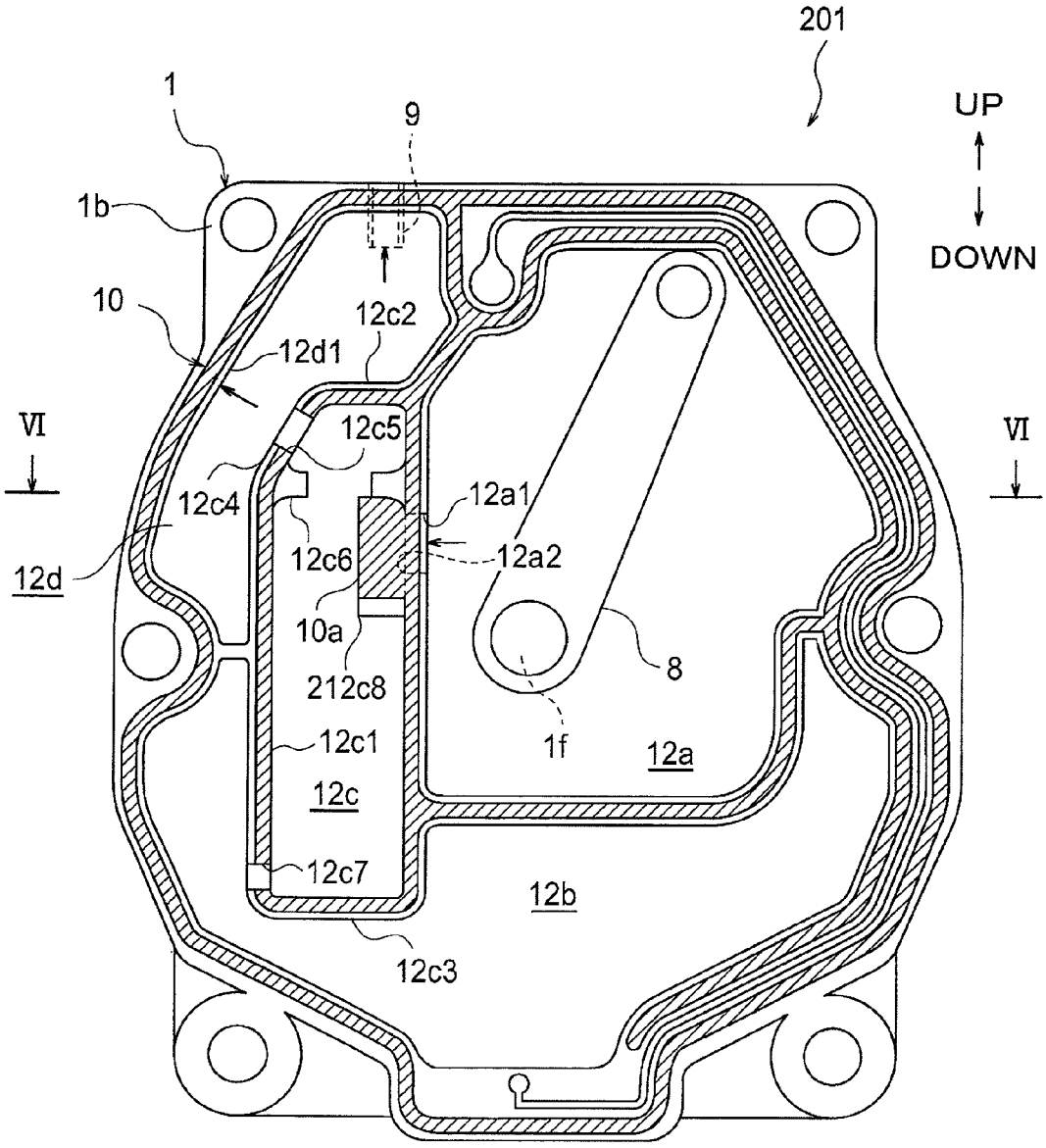
FIG. 5 is a schematic sectional view illustrating the construction of a compressor according to a second embodiment of the present invention.
Figure 6:
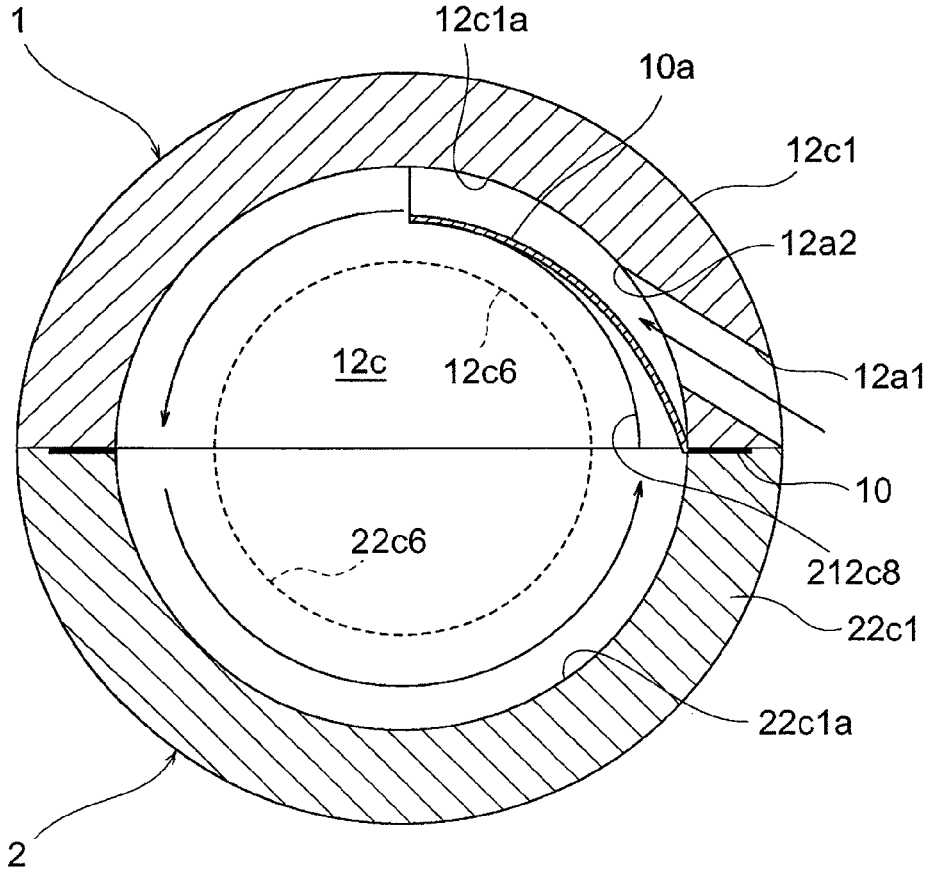
FIG. 6 is a schematic drawing illustrating a cross section taken along the VI-VI line in FIG. 5.

Referring to both FIG. 5 and FIG. 6, the lower guiding plate portion 212*c*8 constituting a lower guiding portion is formed to have a plate-like shape and be integrated with the side circumferential wall 12*c*1 inside the first oil separation chamber 12*c*. The lower guiding plate portion 212*c*8 extends along the inner circumferential surface 12*c*1*a* of the side circumferential wall 12*c*1 and the guiding plate 10*a* below the inflow port 12*a*2 and at the lower side of the guiding plate 10*a*. In other words, the lower guiding plate portion 212*c*8 is formed along the entire length of the guiding plate 10*a* so as to close the gap between the guiding plate 10*a* and the inner circumferential surface 12*c*1*a* from below the guiding plate 10*a*.

In this case, the refrigerant that has flown out from the inflow port 12*a*2 into the first oil separation chamber 12*c* flows in the counterclockwise direction (on FIG. 6) along the guiding plate 10*a* and the inner circumferential surface

12*c*1*a*, while being blocked from flowing upward by the protruding portion 12*c*6 and from flowing downward by the lower guiding plate portion 212*c*8. As a result, a swirling flow along the inner circumferential surfaces 12*c*1*a* and 22*c*1*a* is effectively generated. The lubricating oil contained in the refrigerant is centrifugally separated by the swirling flow.

Other features and operation of the compressor 201 according to the second embodiment of the present invention are similar to those of the compressor 101 of the first embodiment and the explanation thereof is herein omitted.

Thus, the compressor 201 of the second embodiment makes it possible to obtain the effects similar to that obtained with the compressor 101 of the above-described first embodiment.

Further, in the compressor 201, the first oil separation chamber 12*c* has the lower guiding plate portion 212*c*8 extending from the side circumferential wall 12*c*1 below the inflow port 12*a*2 along the inner circumferential wall surface 12*c*1*a* of the side circumferential wall 12*c*1. As a result, the refrigerant that has been discharged from the inflow port 12*a*2 into the first oil separation chamber 12*c* is blocked by the lower guiding plate portion 212*c*8 from flowing downward. Therefore, the swirling flow along the inner circumferential surfaces 12*c*1*a* and 22*c*1*a* can be effectively generated.

Third Embodiment

In a compressor 301 according to a third embodiment of the present invention, the shape of the side circumferential walls in the first oil separation chamber 12*c* of the compressor 201 of the second embodiment is changed.

Figure 7:
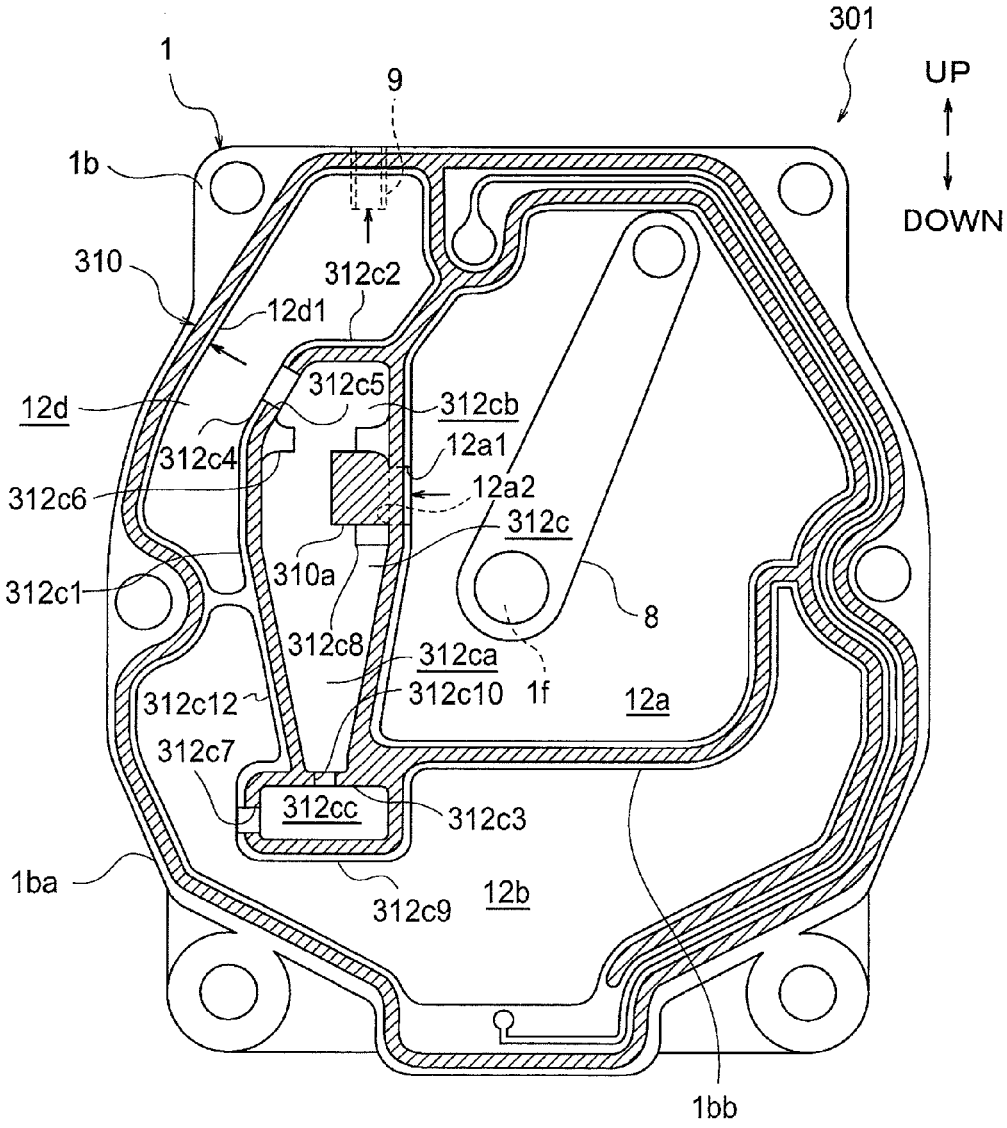
FIG. 7 is a schematic sectional view illustrating the construction of a compressor according to a third embodiment of the present invention.

Referring to FIG. 7, in the shell 1 of the compressor 301, a first oil separation chamber 312*c* having a side circumferential wall 312*c*1, an upper wall 312*c*2, a bottom wall 312*c*3, a tapered wall 312*c*4 and a protruding portion 312*c*6 is formed by the inner wall 1*bb* in the same manner as in the compressors 101 and 201 of the first and second embodiments. Further, an inflow hole 12*a*1 is formed in the side circumferential wall 312*c*1, and an outflow hole 312*c*5 is formed in the tapered wall 312*c*4. A lower guiding plate portion 312*c*8 is formed in the side circumferential wall 312*c*1.

In the first oil separation chamber 312*c*, the side circumferential wall 312*c*1 forms a tapered portion 312*c*12 that tapers downward at the position below the lower guiding plate portion 312*c*8, and a bottom wall 312*c*3 is formed at the lower distal end of the tapered portion 312*c*12. Furthermore, a buffer wall 312*c*9 forming a buffer chamber 312*cc* for temporarily retaining the lubricating oil separated from the refrigerant therein is formed integrally with the bottom wall 312*c*3 below the bottom wall 312*c*3. A lower space 312*ca* of the first oil separation chamber 312*c* and the buffer chamber 312*cc* communicate with each other via a communication hole 312*c*10 formed in the bottom wall 312*c*3. An oil discharge hole 312*c*7 that communicates the buffer chamber 312*cc* with the oil storage chamber 12*b* is formed in the side portion of the buffer wall 312*c*9. In the rear housing 2, the remaining halves of the first oil separation chamber 312*c* and buffer chamber 312*cc* are formed in the same manner as in the shell 1.

Thus, the first oil separation chamber 312*c* has a construction where the lower portion of the lower space 312*ca* has a cylindrical shape that is conically tapered downward and the buffer chamber 312*cc* that communicates with the lower space 312*ca* is provided at the lower side of the first oil separation chamber 312*c*.

A gasket 310 is formed to have a shape surrounding the circumference of the discharge chamber 12*a*, oil storage chamber 12*b*, first oil separation chamber 312*c* and second oil separation chamber 12*d* on the outer circumferential wall 1*ba* and inner wall 1*bb*. The gasket 310 is provided with respect to the first oil separation chamber 312*c* so as to surround the first oil separation chamber 312*c* and the buffer chamber 312*cc*, except for the outflow hole 312*c*5, communication hole 312*c*10 and oil discharge hole 312*c*7. In this configuration, a guiding plate 310*a* is formed integrally with the gasket 310 and extends into the interior of the first oil separation chamber 312*c* similarly to the guiding plates of the compressors 101 and 201 of the first and second embodiments.

In this case, the refrigerant that has flown out from the inflow port 12*a*2 into the lower space 312*ca* of the first oil separation chamber 312*c* generates a swirling flow along the inner circumferential surface of the lower space 312*ca*, while being blocked by the protruding portion 312*c*6 from flowing upward and blocked by the lower guiding plate portion 312*c*8 from flowing downward. The refrigerant flows downward, while swirling, and the lubricating oil contained therein is centrifugally separated in this process. In the tapered portion 312*c*12 in the lower space 312*ca*, the flow velocity of the swirling flow of the refrigerant increases and the contained lubricating oil is centrifugally separated with even higher efficiency. The swirling refrigerant collides with the bottom wall 312*c*3, changes the flow direction, and flows through the center of the swirling flow toward an upper space 312*cb*.

The lubricating oil that has been separated from the refrigerant adheres to the inner circumferential surface of the side circumferential wall 312*c*1, flows down, and flows into the buffer chamber 312*cc*. Where the amount of lubricating oil retained inside the buffer chamber 312*cc* increases, the lubricating oil flows out of the lateral oil discharge hole 312*c*7 into the oil storage chamber 12*b*. As a result, the lubricating oil is not retained in the lower space 312*ca* and therefore the refrigerant flowing toward the bottom wall 312*c*3 does not splash the retained lubricating oil by agitating the surface thereof and the splashed lubricating oil is prevented from being again included in the refrigerant.

Other features and operation of the compressor 301 according to the third embodiment of the present invention are similar to those of the compressor 201 of the second embodiment and the explanation thereof is herein omitted.

Thus, the compressor 301 of the third embodiment makes it possible to obtain the effects similar to those obtained with the compressor 201 of the above-described second embodiment.

Further, in the first oil separation chamber 312*c* of the compressor 301, by providing the tapered portion 312*c*12 that is tapered downward at the lower portion of the side circumferential wall 312*c*1 of the first oil separation chamber 312*c*, it is possible to maintain a high velocity of the swirling flow of the refrigerant. Therefore, the lubricating oil contained in the refrigerant can be separated with higher efficiency.

In the first oil separation chamber 312*c* of the compressor 301, since the buffer chamber 312*cc* communicating with the lower space 312*ca* is provided below the lower space 312*ca* of the first oil separation chamber 312*c*, the surface of the lubricating oil separated from the refrigerant can be prevented from rising due to agitation by the refrigerant flow and the lubricating oil can be prevented from again merging into the refrigerant.

The tapered portion 312*c*12 and the buffer chamber 312*cc* of the first oil separation chamber 312*c* in the compressor 301 can be also used in the first oil separation chamber 12*c* of the compressor 101 of the first embodiment.

Further, in the compressors 101 to 301 of the first to third embodiments, the discharge passage 9 that communicates the second oil separation chamber 12*d* with the outside of the compressors 101 to 301 is provided above the first oil separation chambers 12*c*, 312*c*, but such configuration is not limiting. Since the second oil separation chamber 12*d* serves to cause the collision of the refrigerant with the opposite wall portion 12*d*1 and enhance the separation of the lubricating oil contained in the refrigerant, the position of the discharge passage 9 may be on the side of the first oil separation chambers 12*c*, 312*c*, provided that the position thereof is apart from the opposite wall portion 12*d*1.

Figure 8:
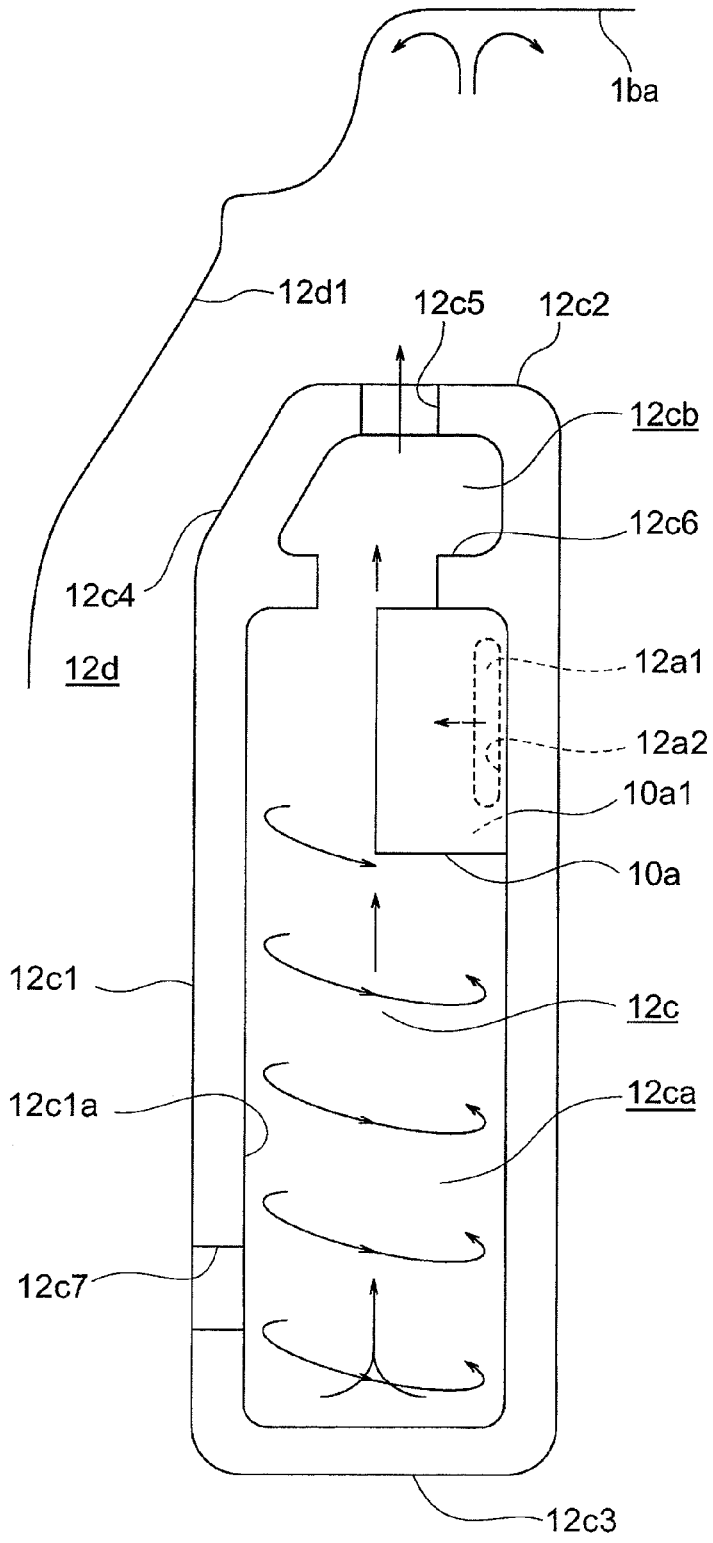
FIG. 8 is a schematic sectional view illustrating a modification example of the first oil separation chamber in the same manner as in FIG. 4.

Further, in the compressors 101 to 301 of the first to third embodiments, the outflow holes 12*c*5, 312*c*5 of the first oil separation chambers 12*c*, 312*c* are formed in the tapered walls 12*c*4, 312*c*4, but such configuration is not limiting. As shown in FIG. 8, the outflow hole 12*c*5 may be formed in the upper wall 12*c*2. In this case, the refrigerant that has flown out of the outflow hole 12*c*5 collides with the inner surface of the outer circumferential wall 1*ba*, and the separation of the lubricating oil contained in the refrigerant can thereby be enhanced.

Figure 9:
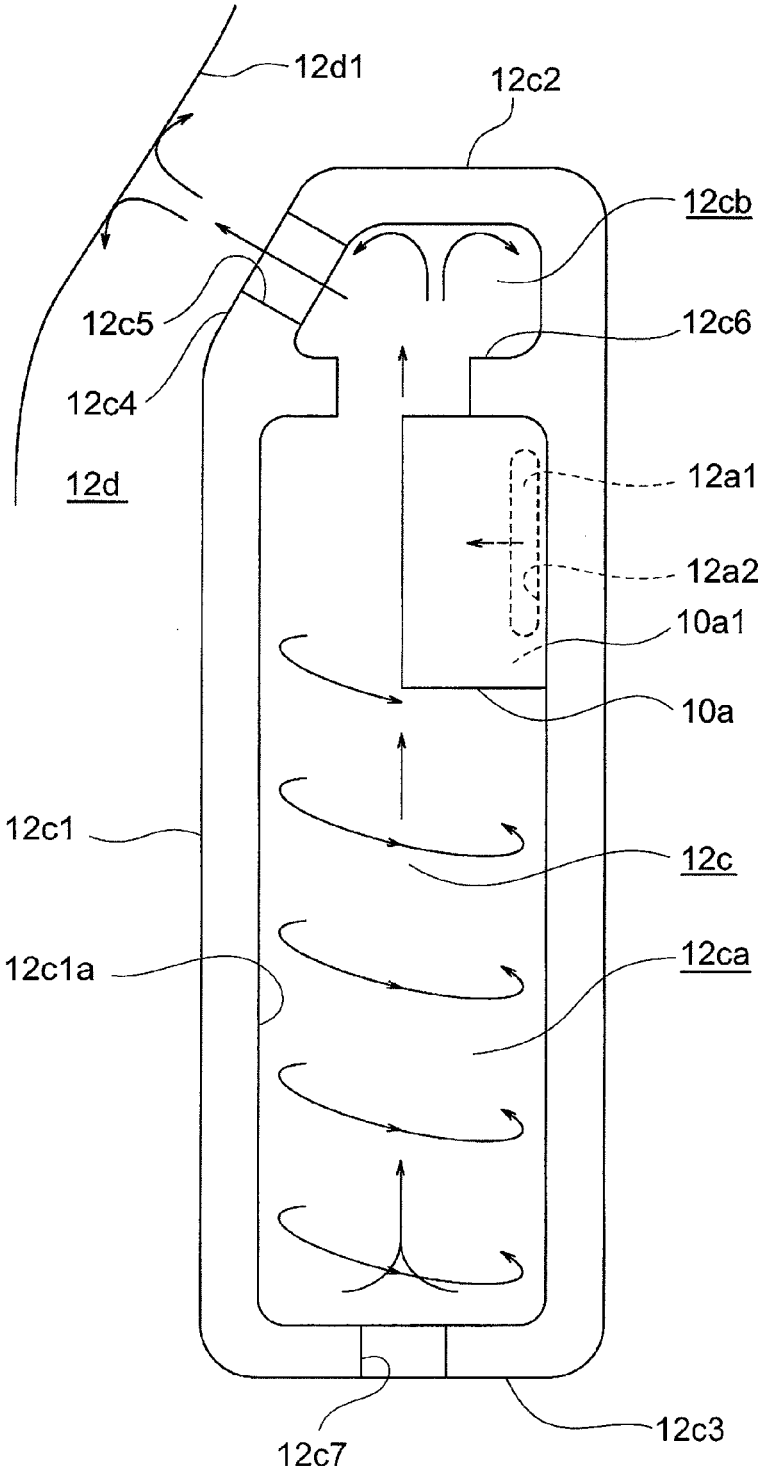
FIG. 9 is a schematic sectional view illustrating a modification example of the first oil separation chamber in the same manner as in FIG. 4.

Further, in the compressors 101 and 201 of the first and second embodiments, the oil discharge hole 12*c*7 of the first oil separation chamber 12*c* is formed in the side circumferential wall 12*c*1, but such configuration is not limiting. As shown in FIG. 9, the oil discharge hole 12*c*7 may be also formed in the bottom wall 12*c*3. As a result, the lubricating oil separated from the refrigerant can be prevented from accumulating inside the first oil separation chamber 12*c*.

Further, in the compressors 101 to 301 of the first to third embodiments, the inflow hole 12*a*1 of the first oil separation chambers 12*c*, 312*c* is formed in the side circumferential walls 12*c*1, 312*c*1 on the shell 1 side, but such configuration is not limiting. The inflow hole 12*a*1 may be also formed in the side circumferential wall 22*c*1 on the rear housing 2 side. In this case, the guiding plates 10*a*, 310*a* extend so as to face the inner circumferential surface 22*c*1*a* of the side circumferential wall 22*c*1.

Figure 10:
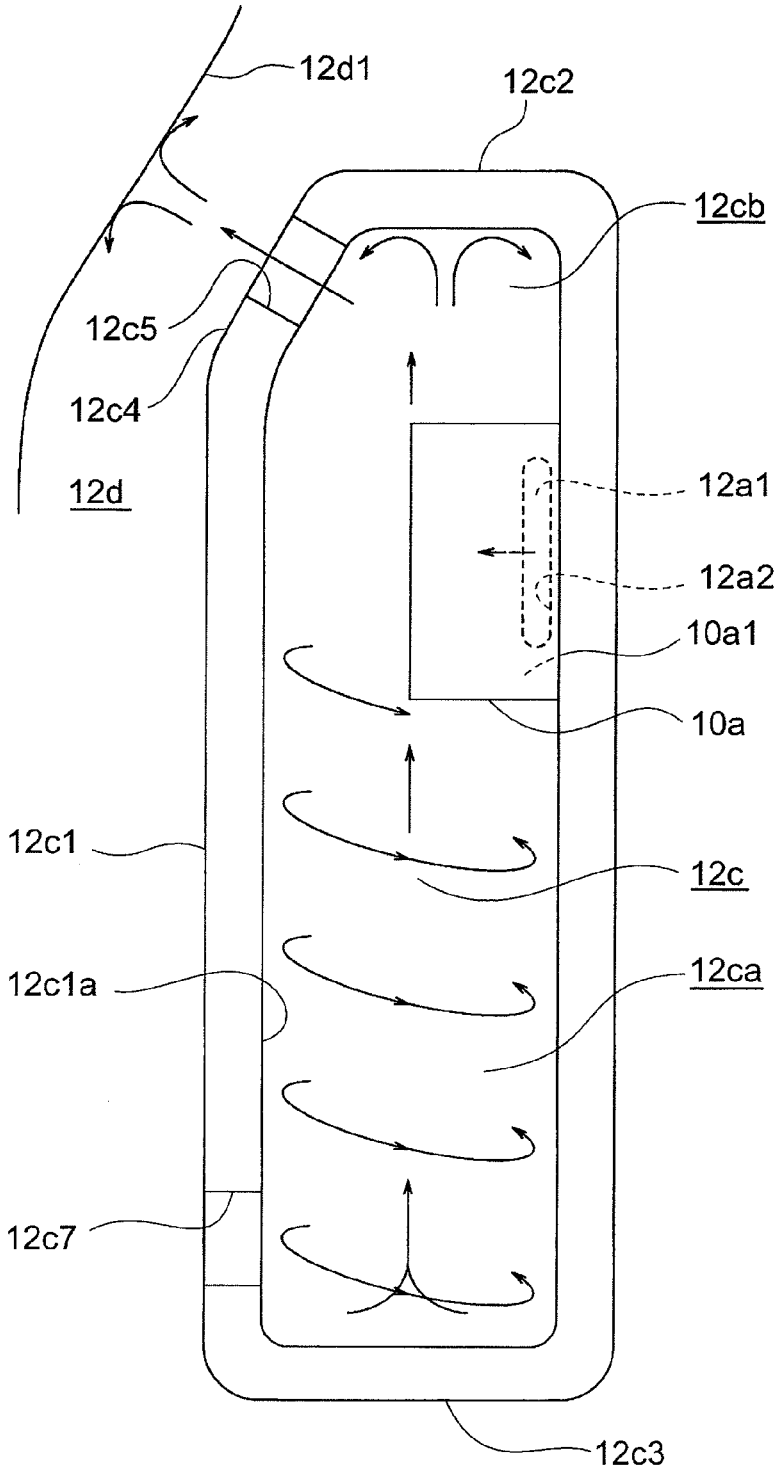
FIG. 10 is a schematic sectional view illustrating a modification example of the first oil separation chamber in the same manner as in FIG. 4.

Further, in the compressors 101 to 301 of the first to third embodiments, the protruding portions 12*c*6, 22*c*6, 312*c*6 that are adjacent to the top of the inflow port 12*a*2 and have an annular band-like shape are formed in the first oil separation chambers 12*c*, 312*c*, but the protruding portions may be omitted as shown in FIG. 10. Thus, a swirling flow having a sufficient lubricating oil separation effect can be generated inside the first oil separation chambers 12*c*, 312*c* for the refrigerant that has flown in from the inflow port 12*a*2 by adjusting the orientation of the inflow hole 12*a*1 with respect to the guiding plate 10*a* and also adjusting the extension direction and length of the guiding plate 10*a*.

Figure 11:
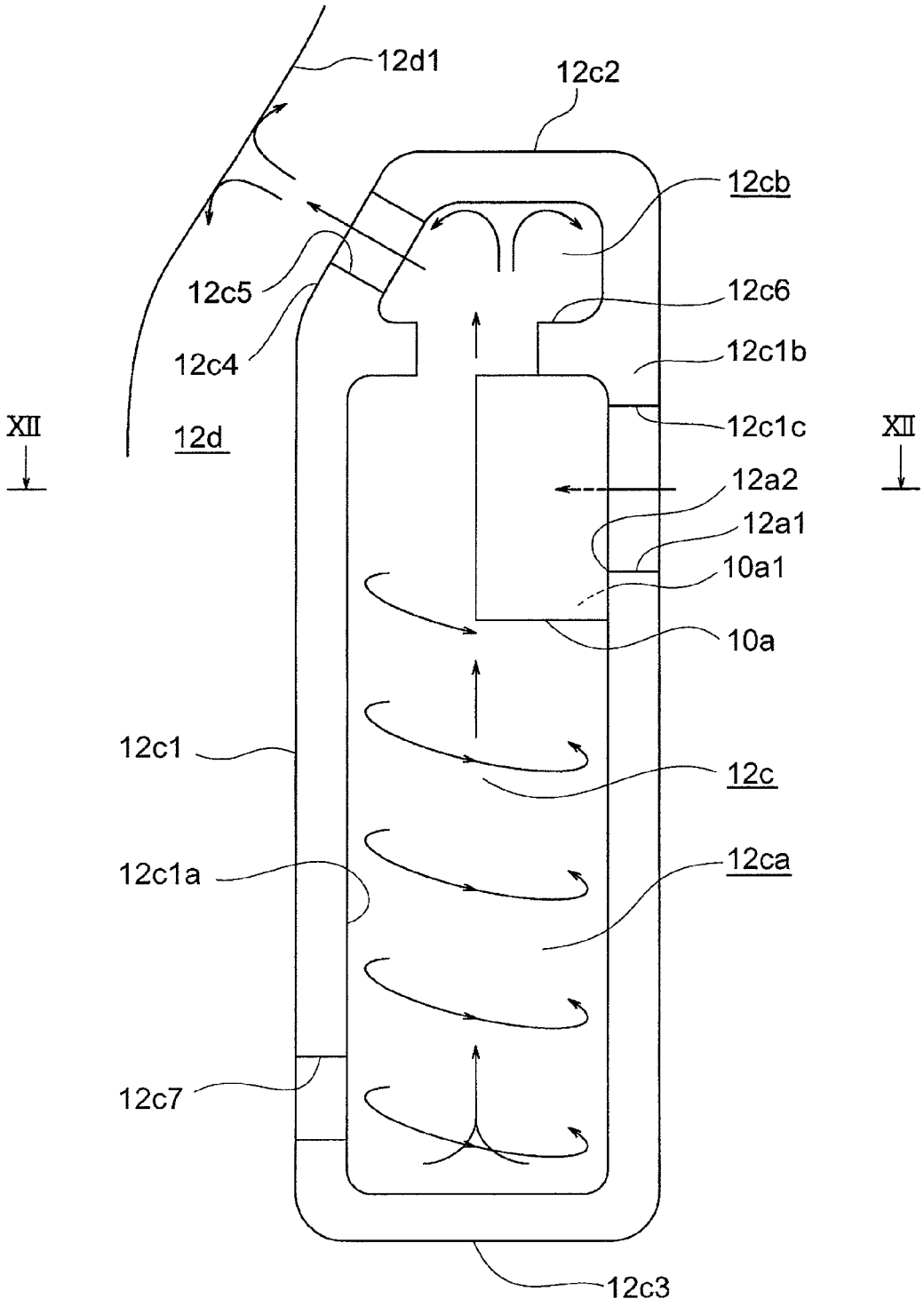
FIG. 11 is a schematic sectional view illustrating a modification example of the first oil separation chamber in the same manner as in FIG. 4.
Figure 12:
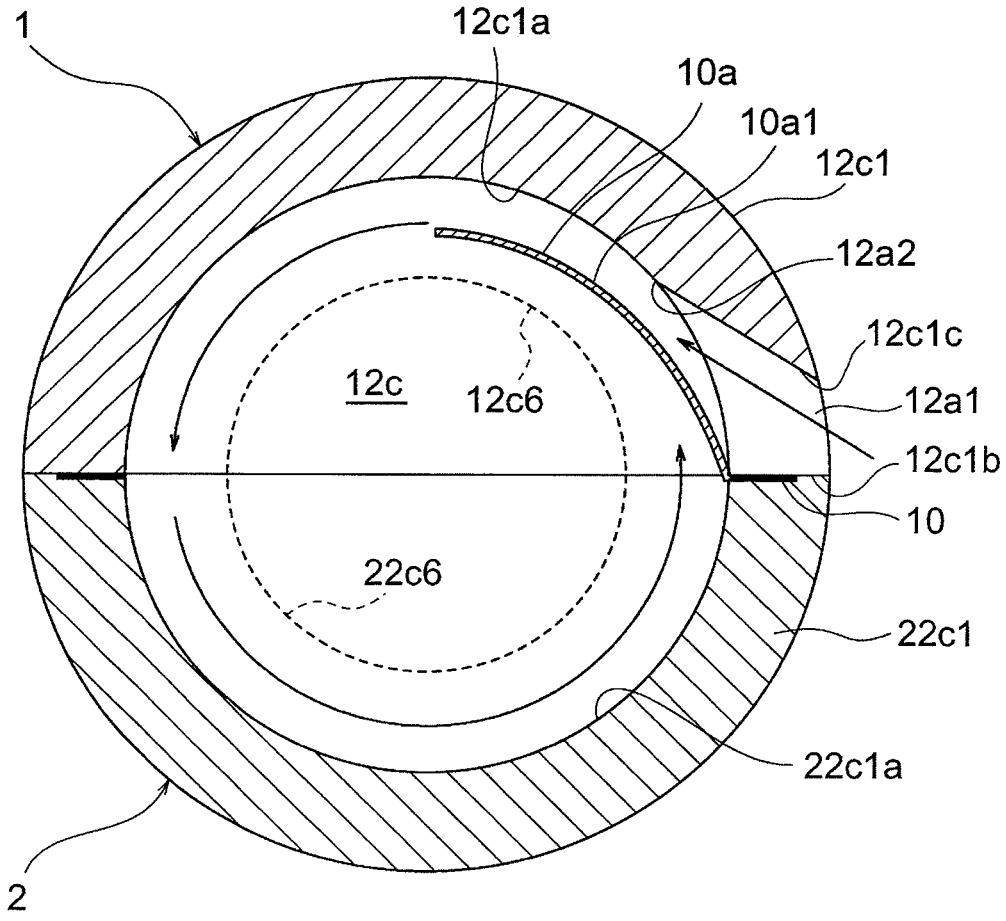
FIG. 12 is a schematic drawing illustrating a cross section taken along the XII-XII line in FIG. 11.

Further, in the compressors 101 to 301 of the first to third embodiments, the inflow hole 12*a*1 of the first oil separation chambers 12*c*, 312*c* is formed in the side circumferential walls 12*c*1, 312*c*1 on the shell 1 side at a distance from the gasket 10, but such configuration is not limiting and, as shown in FIG. 11 and FIG. 12, the inflow hole 12*a*1 may be formed adjacent to the gasket 10. Thus, it is also possible to form the inflow hole 12*a*1 by a groove 12*c*1*c* by forming the groove 12*c*1*c* communicating the discharge chamber 12*a* with the first oil separation chamber 12*c* in the side circumferential wall 12*c*1 on the shell 1 side at the surface 12*c*1*b* thereof that mates with the side circumferential wall 22*c*1 of the rear housing 2 and then by assembling the side circumferential walls 12*c*1 and 22*c*1. In this case, as shown in FIG. 12, the groove 12*c*1*c* may be formed in a direction that guides the fluid flowing in from the inflow port 12*a*2 in the tangential direction of the inner circumferential surface 12*c*1*a* of the first oil separation chamber 12*c*, or the groove 12*c*1*c* may be formed in the opposite direction. Alternatively the groove 12*c*1*c* may be formed parallel to the mating surface 12*c*1*b*. Further, the guiding plate 10*a* in the aforementioned configuration protrudes from the gasket 10 that is inserted between and fixed by the shell 1 and the rear housing 2 above and below the inflow hole 12*a*1. Therefore, the guiding plate 10 can have a strength sufficient to guide the refrigerant flowing out from the inflow port 12*a*2.

Further, in the compressors 101 to 301 of the first to third embodiments, the guiding plates 10*a*, 310*a* are formed along part of the inner circumferential surface of the side circumferential walls 12*c*1, 312*c*1, but such configuration is not limiting. The guiding plates 10*a*, 310*a* may be formed in a tubular shape such as to extend along the entire inner circumferential surface of side circumferential walls of the first oil separation chambers 12*c*, 312*c*. As a result, the swirling flow of the refrigerant can be generated more reliably in the first oil separation chambers 12*c*, 312*c*.

Further, in the compressors 101 to 301 of the first to third embodiments, the guiding plates 10*a*, 310*a* are formed from the same material as the gaskets 10, 310 and integrally therewith, but such configuration is not limiting. Thus, guiding plates 10*a*, 310*a* made from a different material may be attached to the gaskets 10, 310. Further, the guiding plates 10*a*, 310*a* may be formed integrally with the shell 1 or rear housing 2.

Further, in the compressors 101 to 301 of the first to third embodiments, the guiding plates 10*a*, 310*a* are formed so as to cover the inner circumferential surface of the side circumferential walls 12*c*1, 312*c*1 within a range with a central angle $\alpha$ at the central axis (c) of the first oil separation chambers 12*c*, 312*c* close to 90°, but such configuration is not limiting. Thus, the central angle $\alpha$ may be greater or less than 90°, depending on the mutual arrangement and configuration of the guiding plates 10*a*, 310*a* and the inflow how 12*a*1.

Further, in the compressors 101 to 301 of the first to third embodiments, the first oil separation chambers 12*c*, 312*c* are formed to have a shape such that has a round cross section in a direction perpendicular to the axial direction thereof, but such configuration is not limiting and the first oil separation chambers 12*c*, 312*c* may have an annular cross section such as an elliptical cross section.

Further, in the compressors 101 to 301 of the first to third embodiments, the inflow hole 12*a*1 is formed in the tangential direction of the inner circumferential surface of the first oil separation chambers 12*c*, 312*c*, but the inflow hole 12*a*1 may be formed in any direction. Further, the inflow port 12*a*2 is formed at a position close to the position at which the guiding plates 10*a*, 310*a* protrude from the inner circumferential surface of the first oil separation chambers 12*c*, 312*c*, but such configuration is not limiting and the inflow port 12*a*2 may be formed far from the aforementioned position. In this case, the refrigerant flowing in from the inflow port 12*a*2 can be guided by adjusting the length of the guiding plates 10*a*, 310*a*.

The compressors 101 to 301 are not limited to scroll compressors and can be applied to any compressor having a structure in which lubricating oil is contained in the refrigerant after compression.

What is claimed is:

1. A compressor, which compresses a fluid including a lubricating oil, comprising:

a first separation chamber for separating the lubricating oil by generating a swirling flow in the fluid, on a discharge side of the compressor, wherein the first separation chamber includes:

a circumferential wall forming the first separation chamber;

an inflow port that is formed in the circumferential wall of the first separation chamber and causes the fluid to flow into the first separation chamber; and a guiding plate that extends from the circumferential wall of the first separation chamber and along a circumferential direction of an inner circumferential surface of the circumferential wall so as to face the inner circumferential surface, and wherein the guiding plate extends so as to face the inflow port in a direction in which the fluid flows from the inflow port into the first separation chamber, and so as to deflect the flow of the fluid from the inflow port to guide the flow along an inner circumferential surface of the circumferential wall, wherein the circumferential wall of the first separation chamber is formed by a plurality of circumferential wall forming members, the first separation chamber has a gasket between the circumferential wall forming members, and the guiding plate is formed with the gasket.

2. The compressor according to claim 1, further comprising a housing formed by a plurality of housing forming members and constituting a casing, wherein the plurality of circumferential wall forming members of the first separation chamber are provided correspondingly to different housing forming members and formed integrally with corresponding housing forming members.

3. The compressor according to claim 1, wherein the first separation chamber includes a lower guiding portion that extends from the circumferential wall below the inflow port along the inner circumferential surface of the circumferential wall.

4. The compressor according to claim 1, wherein a spacing between the inner circumferential surface of the circumferential wall and an outer surface of the guiding plate increases along the entire outer surface of the guiding plate in a circumferential direction towards a free end of the guiding plate.

5. The compressor according to claim 1, wherein the first separation chamber includes:

an outflow port provided above the inflow port and causing the fluid to flow out from the first separation chamber; and a throttle portion that protrudes from the circumferential wall between the inflow port and the outflow port and reduces a cross sectional area of the first separation chamber.

6. The compressor according to claim 3, further comprising a second separation chamber communicating with the first separation chamber via the outflow port, wherein the second separation chamber has a collision wall portion for causing the fluid that has flown out of the outflow port to collide with the collision wall portion at a position facing the outflow port.

7. The compressor according to claim 5, wherein the first separation chamber includes:

a lower space located below the throttle portion;

an upper space located above the throttle portion; and a collision wall portion in the upper space for causing collision of the fluid flowing from the lower space into the upper space with the collision wall portion to change flow direction of the fluid.

* * * * *